US009734756B2

(12) United States Patent
Gupta et al.

(10) Patent No.: US 9,734,756 B2
(45) Date of Patent: Aug. 15, 2017

(54) ORGANIC LIGHT EMITTING DIODE DISPLAYS WITH REDUCED LEAKAGE CURRENT

(71) Applicant: Apple Inc., Cupertino, CA (US)

(72) Inventors: Vasudha Gupta, Cupertino, CA (US); Tsung-Ting Tsai, Taipei (TW); Jae Won Choi, Cupertino, CA (US); Sang Y. Youn, Cupertino, CA (US); Young Bae Park, San Jose, CA (US)

(73) Assignee: Apple Inc., Cupertino, CA (US)

( * ) Notice: Subject to any disclaimer, the term of this patent is extended or adjusted under 35 U.S.C. 154(b) by 314 days.

(21) Appl. No.: 14/315,783

(22) Filed: Jun. 26, 2014

(65) Prior Publication Data

US 2015/0109276 A1 Apr. 23, 2015

Related U.S. Application Data

(60) Provisional application No. 61/892,903, filed on Oct. 18, 2013.

(51) Int. Cl.
*G09G 3/32* (2016.01)
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0819* (2013.01); *G09G 2300/0842* (2013.01); *G09G 2300/0861* (2013.01); *G09G 2310/0286* (2013.01)

(58) Field of Classification Search
CPC .. G09G 3/3233; G09G 3/3266; G09G 3/3275; G09G 2300/0861
See application file for complete search history.

(56) References Cited

U.S. PATENT DOCUMENTS

| | | | | |
|---|---|---|---|---|
| 7,639,217 | B2 | 12/2009 | Shin | |
| 7,649,513 | B2 | 1/2010 | Park et al. | |
| 8,264,426 | B2 | 9/2012 | Chung | |
| 2009/0201231 | A1* | 8/2009 | Takahara | G09G 3/3233 345/76 |
| 2013/0235003 | A1 | 9/2013 | Chang et al. | |
| 2014/0071114 | A1 | 3/2014 | Kim et al. | |
| 2014/0111403 | A1* | 4/2014 | Kim | G11C 19/28 345/76 |

* cited by examiner

*Primary Examiner* — Temesghen Ghebretinsae
*Assistant Examiner* — Lisa Landis
(74) *Attorney, Agent, or Firm* — Treyz Law Group, P.C.; Jason Tsai

(57) ABSTRACT

An electronic device may be provided with an organic light-emitting diode display. The display may include row driver circuitry that provides an emission control signal at an output terminal to display pixels. The emission control signals may enable or disable light emission by the pixels. The row driver circuitry may include a bootstrapping capacitor that stores charge for boosting a gate signal at an intermediate node for a pull-up transistor above a power supply voltage. The row driver circuitry may include a pull-down transistor coupled to the intermediate node. The source terminal of the pull-down transistor may be coupled to the output terminal or an additional pull-down transistor may be stacked with the pull-down transistor to reduce leakage current. Charge pump circuitry may be coupled to the intermediate node to ensure that the intermediate node is maintained at a voltage above the power supply voltage.

13 Claims, 12 Drawing Sheets

ORGANIC LIGHT EMITTING DIODE DISPLAYS WITH REDUCED LEAKAGE CURRENT

This application claims the benefit of provisional patent application No. 61/892,903, filed Oct. 18, 2013, which is hereby incorporated by reference herein in its entirety.

BACKGROUND

This relates generally to electronic devices and, more particularly, to electronic devices with displays that have thin-film transistors.

Electronic devices often include displays. For example, cellular telephones and portable computers include displays for presenting information to users.

Displays such as organic light-emitting diode displays have an array of display pixels based on light-emitting diodes. In this type of display, each display pixel includes a light-emitting diode and thin-film transistors for controlling application of a signal to the light-emitting diode.

Thin-film display driver circuitry is often included in displays. For example, gate driver circuitry and demultiplexer circuitry on a display may be formed from thin-film transistors. Often the thin-film transistors are required to be all N-type or all P-type transistors. However, it can be challenging to pass logic one values with N-type transistors and logic zero values with P-type transistors. To help pass logical values at power supply voltages, bootstrapping capacitors may be used to store charge, which is used to boost transistor gate voltages above or below power supply voltages. However, if care is not taken, transistor leakage currents can potentially drain the charge stored in the bootstrapping capacitors. It would therefore be desirable to be able to provide improved electronic device displays.

SUMMARY

An electronic device may be provided with a display. The display may have an array of display pixels on a substrate. The display pixels may be organic light-emitting diode display pixels. The display may include only n-type or only p-type thin-film transistors. The display may include row driver circuitry that provides emission control signals to the display pixels. The emission control signals may enable or disable light emission by the pixels.

The row driver circuitry for a given row may include an output terminal at which an emission control signal for that row is produced. The row driver circuitry may include an input terminal that receives a periodic input signal and a pull-down transistor having a source terminal and also a gate terminal that is coupled to the input terminal. A path may electrically couple the source terminal to the output terminal to help reduce leakage through the first pull-down transistor. A pull-up transistor may be coupled between a positive power supply terminal and the output terminal and helps maintain the emission control signal at a positive power supply voltage during display pixel emissions. The pull-up transistor may have a second gate terminal that is coupled to an intermediate node. A bootstrap capacitor may be coupled between the intermediate terminal and the output terminal and may help the pull-up transistor to maintain the voltage at the intermediate node above the positive power supply voltage.

If desired, the row driver circuitry may include charge pump circuitry that is coupled to intermediate node. The charge pump circuitry may periodically drive voltage at the intermediate node higher than the positive power supply voltage to help the pull-up transistor ensure that the emission control signal is maintained at the positive power supply voltage.

If desired, the pull-down transistor may be coupled in series with a second pull-down transistor between the intermediate node and a ground power supply terminal. Voltage at the intermediate node may be divided between the first and second pull-down transistors and leakage current through the first and second pull-down transistors may be reduced.

DETAILED DESCRIPTION

Figure 1:
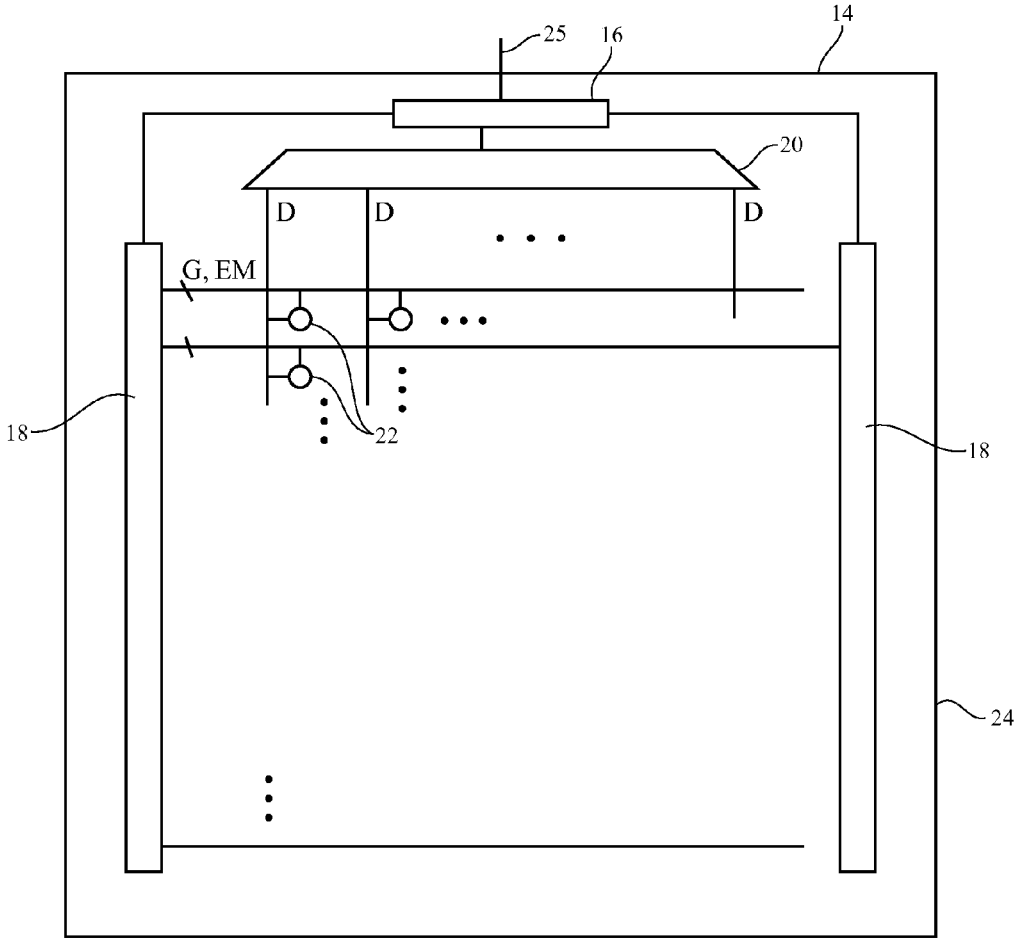
FIG. 1 is a diagram of an illustrative display such as an organic light-emitting diode display having an array of organic light-emitting diode display pixels having an array of display pixels in accordance with an embodiment.

A display in an electronic device may be provided with driver circuitry for displaying images on an array of display pixels. An illustrative display is shown in FIG. 1. As shown in FIG. 1, display 14 may have one or more layers such as substrate 24. Layers such as substrate 24 may be formed from planar rectangular layers of material such as planar glass layers. Display 14 may have an array of display pixels 22 for displaying images for a user. The array of display pixels 22 may be formed from rows and columns of display pixel structures on substrate 24. There may be any suitable number of rows and columns in the array of display pixels 22 (e.g., ten or more, one hundred or more, or one thousand or more).

Display driver circuitry such as display driver integrated circuit 16 may be coupled to conductive paths such as metal traces on substrate 24 using solder or conductive adhesive. Display driver integrated circuit 16 (sometimes referred to as a timing controller chip) may contain communications circuitry for communicating with system control circuitry over path 25. Path 25 may be formed from traces on a flexible printed circuit or other cable. The control circuitry may be located on a main logic board in an electronic device such as a cellular telephone, computer, set-top box, media player, portable electronic device, or other electronic equipment in which display 14 is being used. During operation, the control circuitry may supply display driver integrated circuit 16 with information on images to be displayed on display 14. To display the images on display pixels 22, display driver integrated circuit 16 may supply corresponding image data to data lines D while issuing clock signals and other control signals to supporting thin-film transistor display driver circuitry such as row driver circuitry 18 and demultiplexing circuitry 20. Row driver circuitry 18 may include gate driver circuitry, emission control driver circuitry, and/or other row control signals.

Gate driver circuitry 18 may be formed on substrate 24 (e.g., on the left and right edges of display 14, on only a single edge of display 14, or elsewhere in display 14). Demultiplexer circuitry 20 may be used to demultiplex data signals from display driver integrated circuit 16 onto a plurality of corresponding data lines D. With this illustrative arrangement of FIG. 1, data lines D run vertically through display 14. Each data line D is associated with a respective column of display pixels 22. Gate lines G run horizontally through display 14. Each gate line G is associated with a respective row of display pixels 22. Similarly, additional row lines may pass control signals such as emission control signals (EM) to each row of display pixels 22. Driver circuitry 18 may be located on the left side of display 14, on the right side of display 14, or on both the right and left sides of display 14, as shown in FIG. 1.

Gate driver circuitry 18 may assert gate signals (sometimes referred to as scan signals) on the gate lines G in display 14. For example, gate driver circuitry 18 may receive clock signals and other control signals from display driver integrated circuit 16 and may, in response to the received signals, assert a gate signal on gate lines G in sequence, starting with the gate line signal G in the first row of display pixels 22. As each gate line is asserted, the corresponding display pixels in the row in which the gate line is asserted will display the display data appearing on the data lines D.

Display driver circuitry such as demultiplexer circuitry 20 and gate line driver circuitry 18 may be formed from thin-film transistors on substrate 24. Thin-film transistors may also be used in forming circuitry in display pixels 22. To enhance display performance, thin-film transistor structures in display 14 may be used that satisfy desired criteria such as leakage current, switching speed, drive strength, uniformity, etc. The thin-film transistors in display 14 may, in general, be formed using any suitable type of thin-film transistor technology (e.g., silicon-based, semiconducting-oxide-based, etc.).

Figure 2:
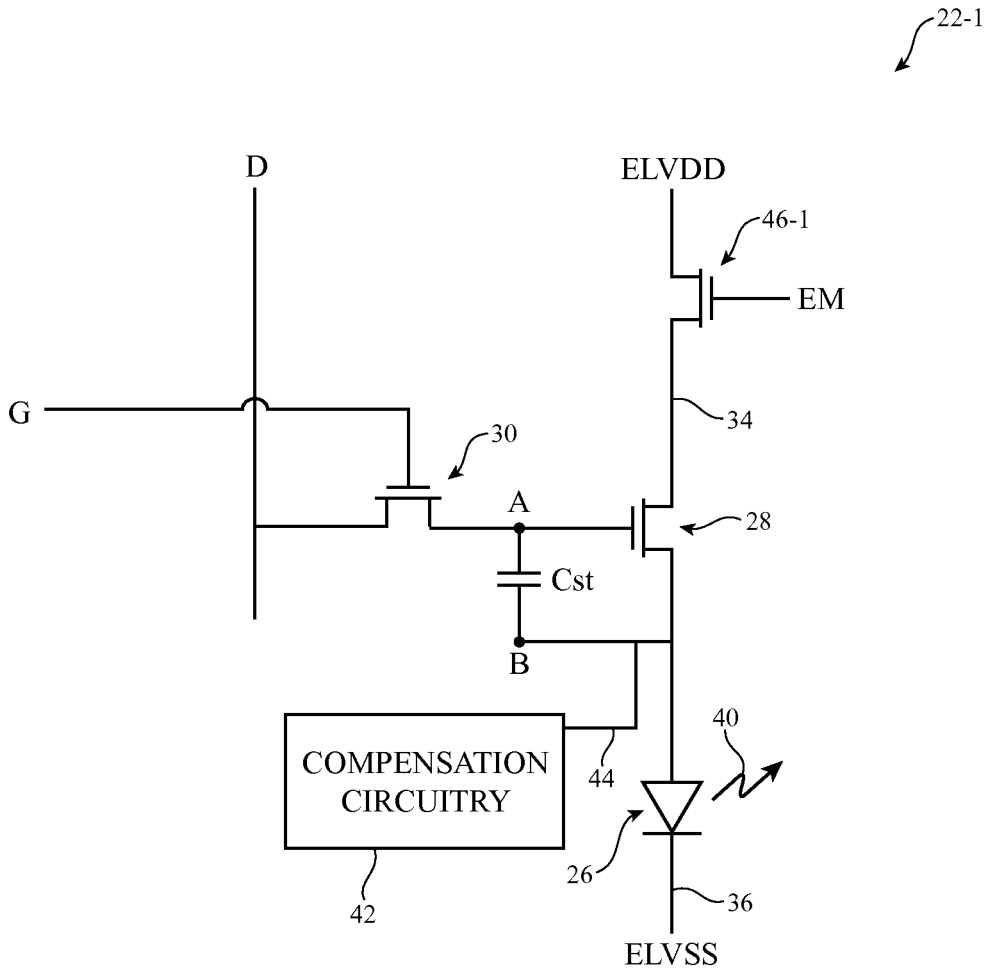
FIG. 2 is a diagram of a first illustrative organic light-emitting diode display pixel of the type that may be used in an organic light-emitting diode display in accordance with an embodiment.

In an organic light-emitting diode display, each display pixel contains a respective organic light-emitting diode. A schematic diagram of an illustrative organic light-emitting diode display pixel 22-1 is shown in FIG. 2. As shown in FIG. 2, display pixel 22-1 may include light-emitting diode 26. A positive power supply voltage ELVDD may be supplied to positive power supply terminal 34 and a ground power supply voltage ELVSS may be supplied to ground power supply terminal 36. The state of drive transistor 28 controls the amount of current flowing through diode 26 and therefore the amount of emitted light 40 from display pixel 22-1.

To ensure that transistor 28 is held in a desired state between successive frames of data, display pixel 22-1 may include a storage capacitor such as storage capacitor Cst. The voltage on storage capacitor Cst is applied to the gate of transistor 28 at node A to control transistor 28. Data can be loaded into storage capacitor Cst using one or more switching transistors such as switching transistor 30. When switching transistor 30 is off, data line D is isolated from storage capacitor Cst and the gate voltage on terminal A is equal to the data value stored in storage capacitor Cst (i.e., the data value from the previous frame of display data being displayed on display 14). When gate line G (sometimes referred to as a scan line) in the row associated with display pixel 22-1 is asserted, switching transistor 30 will be turned on and a new data signal on data line D will be loaded into storage capacitor Cst. The new signal on capacitor Cst is applied to the gate of transistor 28 at node A, thereby adjusting the state of transistor 28 and adjusting the corresponding amount of light 40 that is emitted by light-emitting diode 26. Transistor 28 may sometimes be referred to as a voltage-controlled current source, because voltage applied to the gate of transistor 28 controls the current that flows through diode 26.

Display pixels may be subject to manufacturing variations, stress, or other factors that cause operating variations in the transistors of the display pixels. For example, variations in drive transistor 28 may undesirably alter the amount of current that is produced by drive transistor 28 and corresponding light 40 produced by diode 26. Display pixel 22-1 may include compensation circuitry 42 that help to counteract variations and help ensure consistent operation of drive transistor 28. As an example, compensation circuitry 42 may include between 2-4 transistors that are controlled to account for variations in the threshold voltage of drive transistor 28. As shown in FIG. 2, compensation circuitry 42 may be coupled to drive transistor 28. If desired, capacitor Cst may form part of compensation circuitry 42 and compensation circuitry 42 may be coupled to the gate and/or the source terminals of transistor 28. Compensation circuitry 42 may perform compensation operations such as sample-and-hold of the threshold voltage of drive transistor 28.

Display pixel 22-1 may include emission control transistor 46-1 that controls whether drive transistor 28 is enabled or disabled. Emission control transistor receives emission control signal EM that enables or disables current flow through transistors 46-1 and 28 and diode 26. For example, when emission control signal EM is asserted (e.g., logic one), transistor 46-1 is enabled and allows current flow. Conversely, when emission control signal EM is de-asserted (e.g., logic zero), transistor 46-1 may be disabled and blocks substantial current flow.

Figure 3:
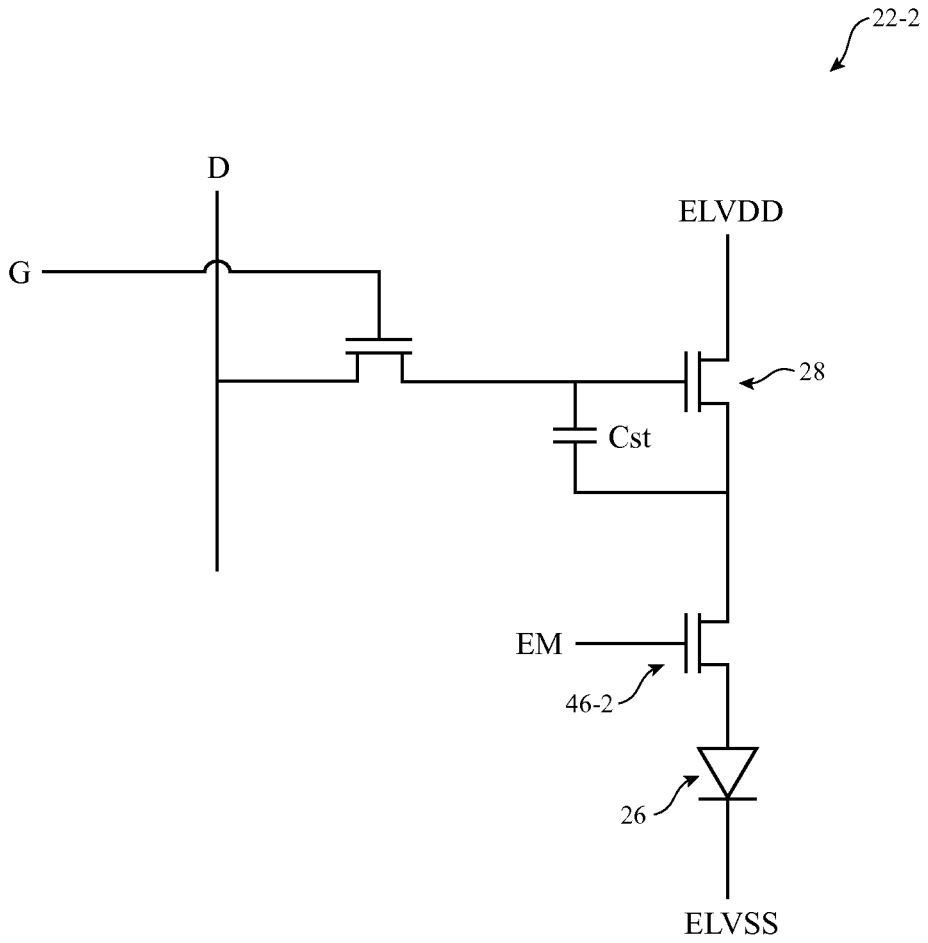
FIG. 3 is a diagram of a second illustrative organic light-emitting diode display pixel of the type that may be used in an organic light-emitting diode display in accordance with an embodiment.
Figure 4:
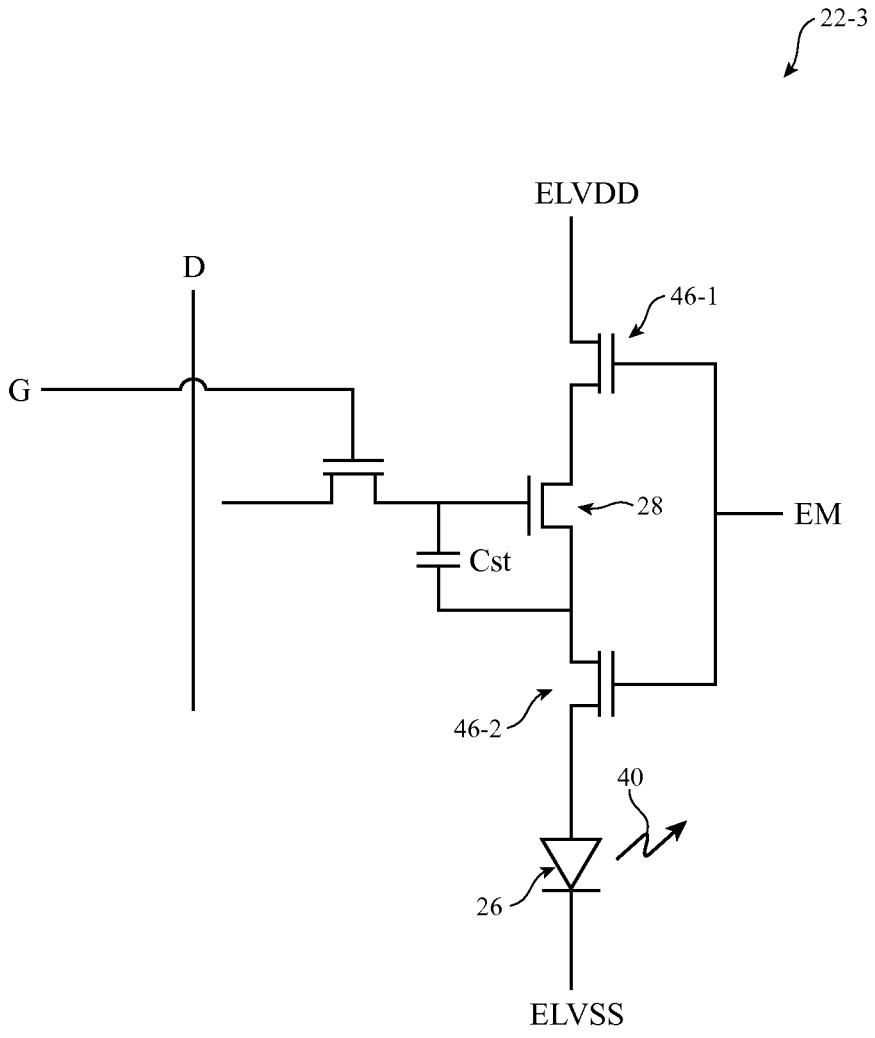
FIG. 4 is a diagram of a third illustrative organic light-emitting diode display pixel of the type that may be used in an organic light-emitting diode display in accordance with an embodiment.

In the example of FIG. 2, emission control transistor 46-1 is interposed between drive transistor 28 and a positive power supply terminal (e.g., transistor 46-1 is coupled in series between drive transistor 28 and the positive power supply terminal). However, this example is merely illustrative. If desired, emission control transistor 46 may be interposed between drive transistor 28 and a ground power supply terminal as shown in FIG. 3. In the example of FIG. 3, emission control transistor 46-2 of pixel 22-2 is coupled in series between drive transistor 28 and diode 26 and functions similarly to emission control transistor 46-1 of FIG. 2. If desired, a display pixel may be provided with multiple emission control transistors for improved control over current flow through drive transistor 28. FIG. 4 is a diagram of an illustrative display pixel 22-3 having emission control transistors 46-1 and 46-2. Emission control transistors 46-1 and 46-2 may be controlled by emission control signal EM to collectively enable or disable drive transistor 28 and control whether or not diode 26 emits light 40.

Emission control signal EM is typically asserted throughout substantially all of a display frame (e.g., during pixel emissions and excluding pixel initialization operations such as compensation of drive transistor variations during which it may be desirable to temporarily disable current flow through drive transistor 28 and/or diode 26). Pixel operations during each display frame may occur during a length of time dependent on the refresh rate of the display. For example, at a refresh rate of 60 Hz, the length of each display frame may be about 16 milliseconds, whereas pixel initialization operations may occupy only about 10-30 microseconds of each display frame. It may be desirable to reduce the refresh rate to lower frequencies such as between 10-20 Hz (e.g., 15 Hz). Operating at reduced refresh rates may help to reduce active transistor switching rates, which may help to reduce power consumption and increase battery life.

Transistors such as thin-film transistors formed on a display substrate may be N-type or P-type transistors. In some scenarios, all of the transistors of the display may be formed of the same transistor type (e.g., N-type or P-type). Forming all transistors of a display using a single transistor type may help to reduce fabrication complexity and cost, but can introduce challenges. For example, it can be challenging to transfer logic one values using N-type transistors (e.g., an N-type transistor may introduce a threshold voltage drop when transferring logic one values between source-drain terminals of the N-type transistor). Similarly, it can be challenging to transfer logic zero values using P-type transistors (e.g., a P-type transistor may introduce a threshold voltage increase when transferring logic zero values). It would therefore be desirable to provide improved driver circuitry for providing control signals such as emission control signals to display pixels. Examples may be described herein in which the transistors of a display are N-type. However, it should be understood that the transistors of a display may be P-type and that circuit configurations may be converted to P-type arrangements by inverting control signals, power supply signals, and transistor types.

Figure 5:
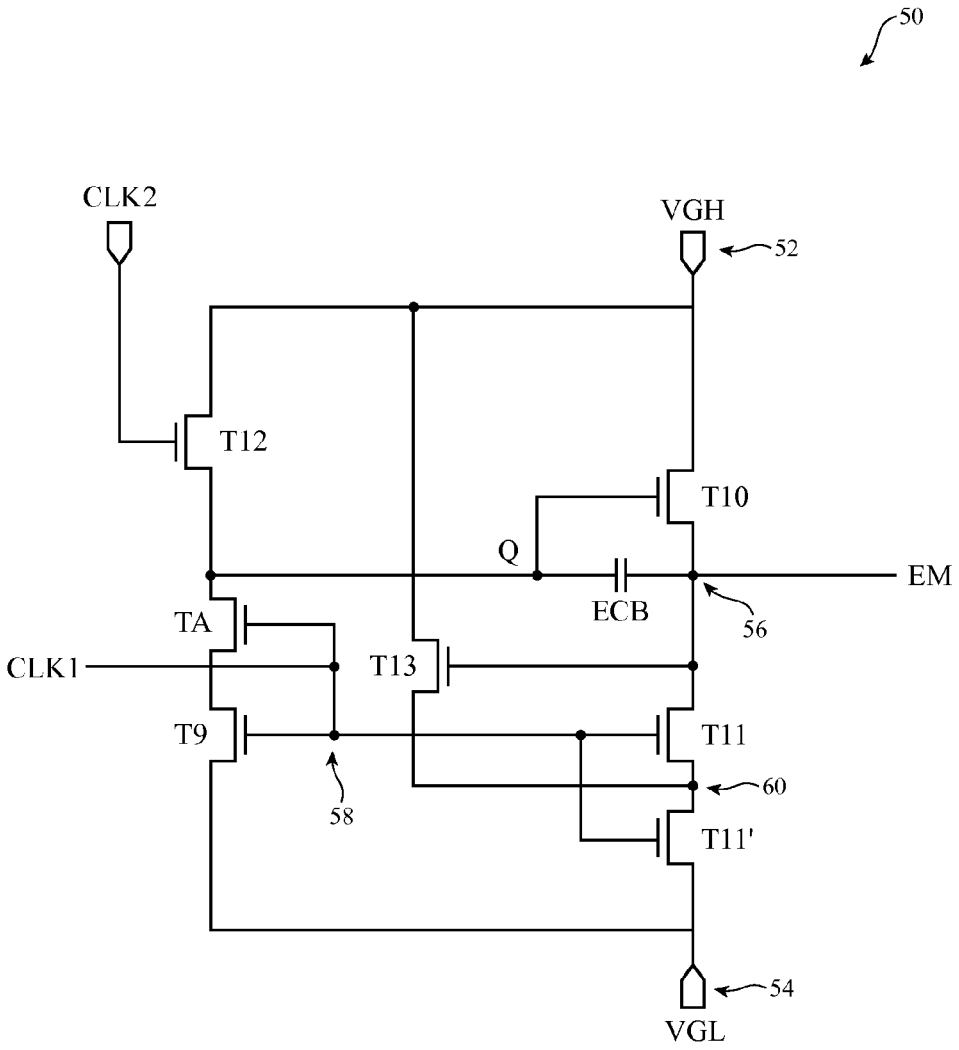
FIG. 5 is a circuit diagram of driver circuitry in thin-film display driver circuitry with capacitive charge boosting and a stacked transistor arrangement that may provide reduced current leakage in accordance with an embodiment.

FIG. 5 is a diagram of illustrative emission control signal driver circuitry 50 that produces emission control signal EM. As an example, emission control signal driver 50 may form part of row driver circuitry 18 of FIG. 1 and provide emission control signal EM for a row of pixels 22. In this scenario, each pixel row may have a corresponding emission control signal driver 50. As shown in FIG. 5, driver circuitry 50 may include transistors T9, T10, T11, T11', T12, and T13.

Transistors T10, T11, and T11' may be coupled in series between a positive supply voltage terminal 52 and a ground supply voltage terminal 54. Positive supply voltage VGH may be supplied at positive supply voltage terminal 52, whereas ground supply voltage VGL may be supplied at terminal 54. Transistor T10 may serve as a pull-up transistor that is controlled by the voltage at node Q (e.g., node Q is coupled to the gate terminal of transistor T10). Transistors T11 and T11' may serve as pull-down transistors that receive input clock signal CLK1 via node 58 (e.g., a periodic signal). Emission control signal EM may be produced at output node 56, which may be coupled to source-drain terminals of transistors T10 and T11.

Transistors T12, TA, and T9 may be coupled in series between positive power supply terminal 52 and ground power supply terminal 54. Transistor T12 may serve as a pull-up transistor controlled by input clock signal CLK2. Transistors TA and T9 may serve as pull-down transistors that receive input clock signal CLK1 via node 58. Transistor T13 may be coupled between positive power supply terminal 52 and node 60 that is interposed between transistors T11 and T11' (e.g., between source-drain terminals of transistors T11 and T11'. The gate of transistor T13 may be coupled to output node 56. When output signal EM is logic one, transistor T13 may pull node 60 towards positive power supply voltage 52, which helps to reduce the source-drain voltage across transistors T11 and T11' and therefore helps to reduce leakage current through transistors T11 and T11'.

In the example of FIG. 5, transistors T9-T13 are N-type transistors for which it is challenging to pass logic one voltages. Consider the scenario in which CLK2 has a logic one voltage (e.g., VGH). Transistor T12 may introduce a threshold voltage (VT) drop in passing voltage VGH from supply terminal 52 to node Q such that node Q has voltage VGH-VT (e.g., because transistor turns off when the gate-source voltage falls below the threshold voltage). Transistor T10 may introduce yet another threshold voltage drop such that output signal EM has voltage VGH-2*VT. To help ensure that the voltage of emission control signal EM is maintained at a voltage at or above the logic one voltage (e.g., above VGH), capacitor ECB may be coupled between node Q and output node 56 (i.e., between the gate and source terminals of transistor T10). Capacitor ECB serves as a bootstrap capacitor that boosts the gate-to-source voltage of transistor T10 (e.g., because charge stored across capacitor ECB helps to ensure that the gate-to-source voltage of transistor T10 is maintained above the transistor threshold voltage even when the voltage at node Q exceeds the ability of transistor T12 to supply additional current). As an example, capacitor ECB may boost the voltage at node Q between 3 and 7 volts (e.g., 6 volts) above the voltage at output node 56.

Figure 6:
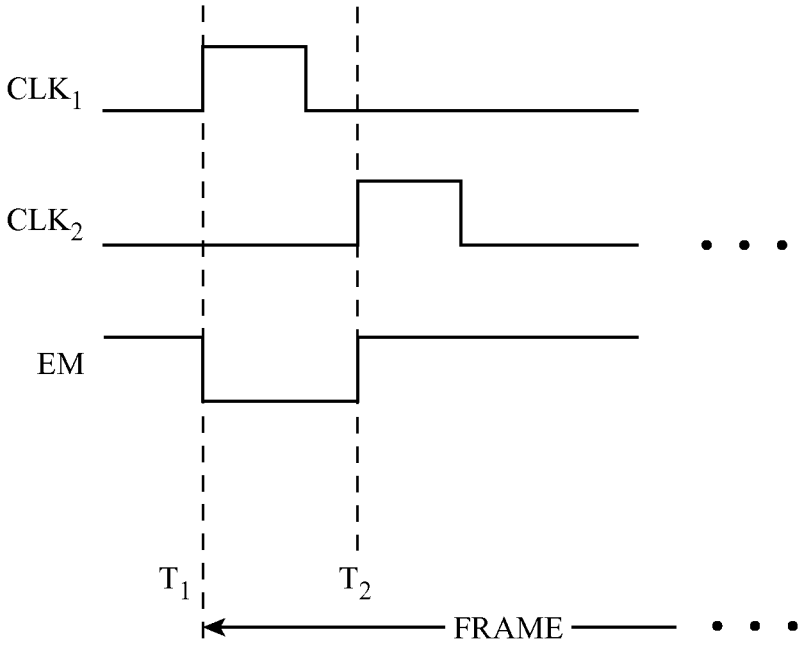
FIG. 6 is a timing diagram illustrating operations of the driver circuitry of FIG. 5 to produce an emission control signal in accordance with an embodiment.

Input clock signals CLK1 and CLK2 may control the operations of driver circuitry 50. FIG. 6 is an illustrative timing diagram showing how input signals CLK1 and CLK2 may control driver circuitry 50 to produce emission control signal EM. As shown in FIG. 6, clock signal CLK1 and CLK2 may be initially logic zero. At time T1, clock signal CLK1 may be asserted, which enables transistors TA, T9, T11, and T11' to pull down node Q and output node 56 to logic zero. Prior to time T2, clock signal CLK1 may be de-asserted, which isolates node Q and output node 56 (e.g., nodes Q and 56 are floating). At time T2, clock signal CLK2 may be asserted, which enables transistor T12 to pull node Q towards voltage VGH. Capacitor ECB may help boost the voltage at node Q to greater than a threshold voltage above voltage VGH, which helps ensure that transistor T10 passes voltage VGH to output node 56.

Emission control signal EM may be asserted for the remaining time of the frame after time T2. However, transistors such as transistor T9 may allow some current flow even when disabled by de-assertion of clock signal CLK1 (e.g., due to leakage current). The leakage current can substantially reduce the charge stored across capacitor ECB over the length of the display frame. To help ensure that emission control voltage EM is maintained at logic one, transistor TA may be stacked with transistor T9 (i.e., coupled in series). The voltage at node Q may be divided between transistors TA and T9, which reduces the source-drain voltage of each individual transistor and therefore reduces the leakage current of transistors TA and T9 and helps to ensure that the charge across capacitor ECB is maintained.

Figure 7:
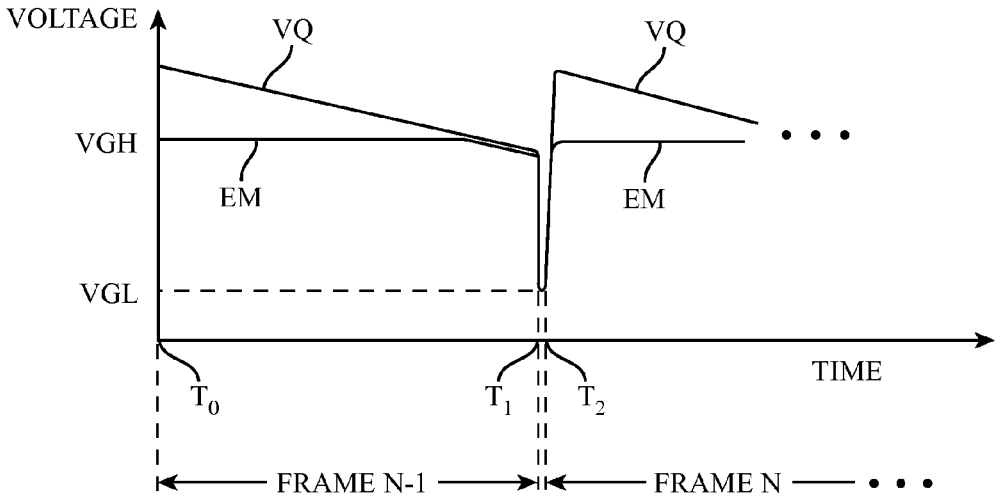
FIG. 7 is a timing diagram illustrating how the stacked transistor arrangement of FIG. 5 may help to ensure that an emission control signal is maintained at a logic one voltage in accordance with an embodiment.

As shown in the illustrative timing diagram of FIG. 7, transistor TA helps to maintain the voltage at node Q (i.e., VQ) above supply voltage VGH for each display frame (e.g., frames N−1 and N). Maintaining voltage VQ above supply voltage VGH helps to ensure that transistor T10 remains enabled throughout each display frame and emission control signal EM is maintained at voltage VGH (excluding initialization operations such as between times T1-T2).

Figure 8:
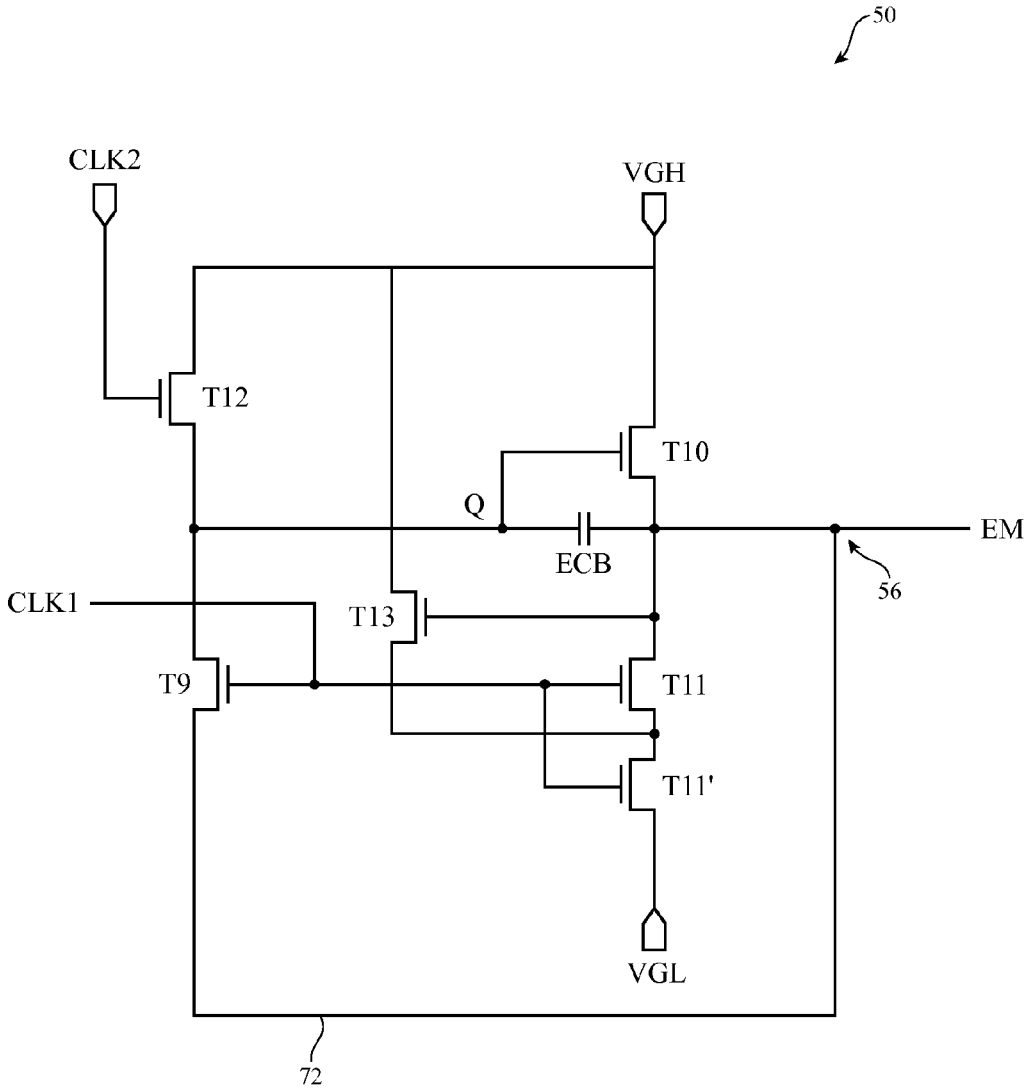
FIG. 8 is a circuit diagram of driver circuitry in thin-film display driver circuitry with capacitive charge boosting and reduced current leakage in accordance with an embodiment.

The example of FIG. 5 in which emission control signal EM is maintained at logic one using transistor TA is merely illustrative. As shown in FIG. 8, the source terminal of transistor T9 may be coupled to output node 56 via path 72 to help ensure that emission control signal EM is maintained at a logic one voltage. When the voltage at node Q is boosted by capacitor ECB (VECB) and output node 56 is asserted, the logic one output voltage is conveyed to the source terminal of transistor T9 via path 72. Node Q may have voltage VGH plus the voltage across capacitor ECB. Therefore, the source-drain voltage of transistor T9 may be reduced to the voltage across capacitor ECB (i.e., VGH+VECB−VGH). For example, the source-drain voltage of transistor T9 may be only 6 volts. In addition, input clock signal CLK1 may be logic zero (e.g., VGL) during pixel emissions and therefore the gate-source voltage may be reduced to logic zero minus logic one (e.g., VGL−VGH), which may further reduce leakage current through transistor T9.

Figure 9:
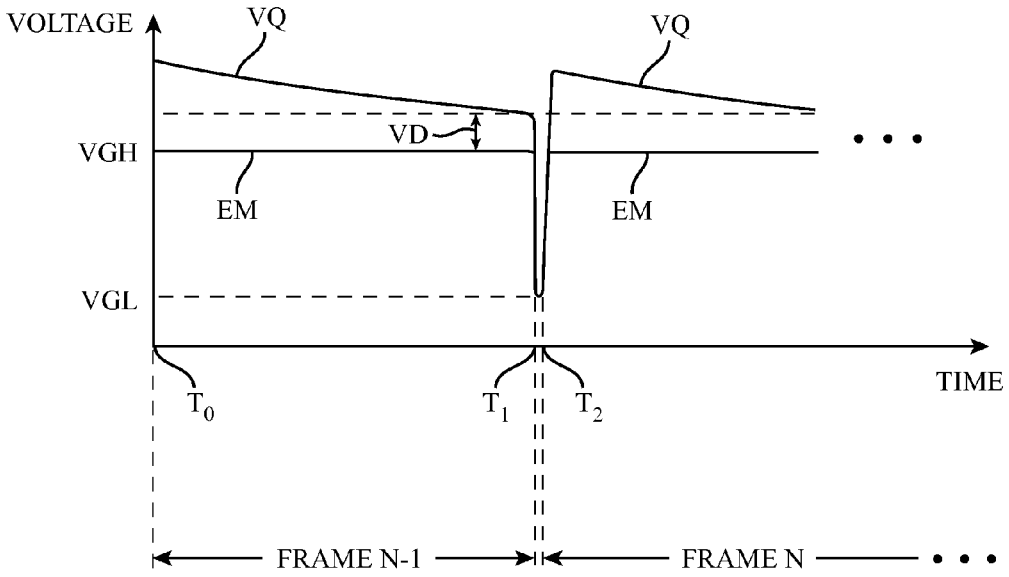
FIG. 9 is a timing diagram illustrating how the driver circuitry of FIG. 8 may help to ensure that an emission control signal is maintained at a logic one voltage in accordance with an embodiment.

Operations of driver circuitry 50 of FIG. 8 are illustrated by the timing diagram of FIG. 9. As shown in FIG. 9, voltage VQ of node Q may be maintained at or above a voltage VD above VGH during pixel emissions of each frame, which helps to ensure that the voltage of emission control signal EM is maintained at VGH (logic one). Voltage VD may, for example, be 6 volts (e.g., the voltage across capacitor CST).

Figure 10:
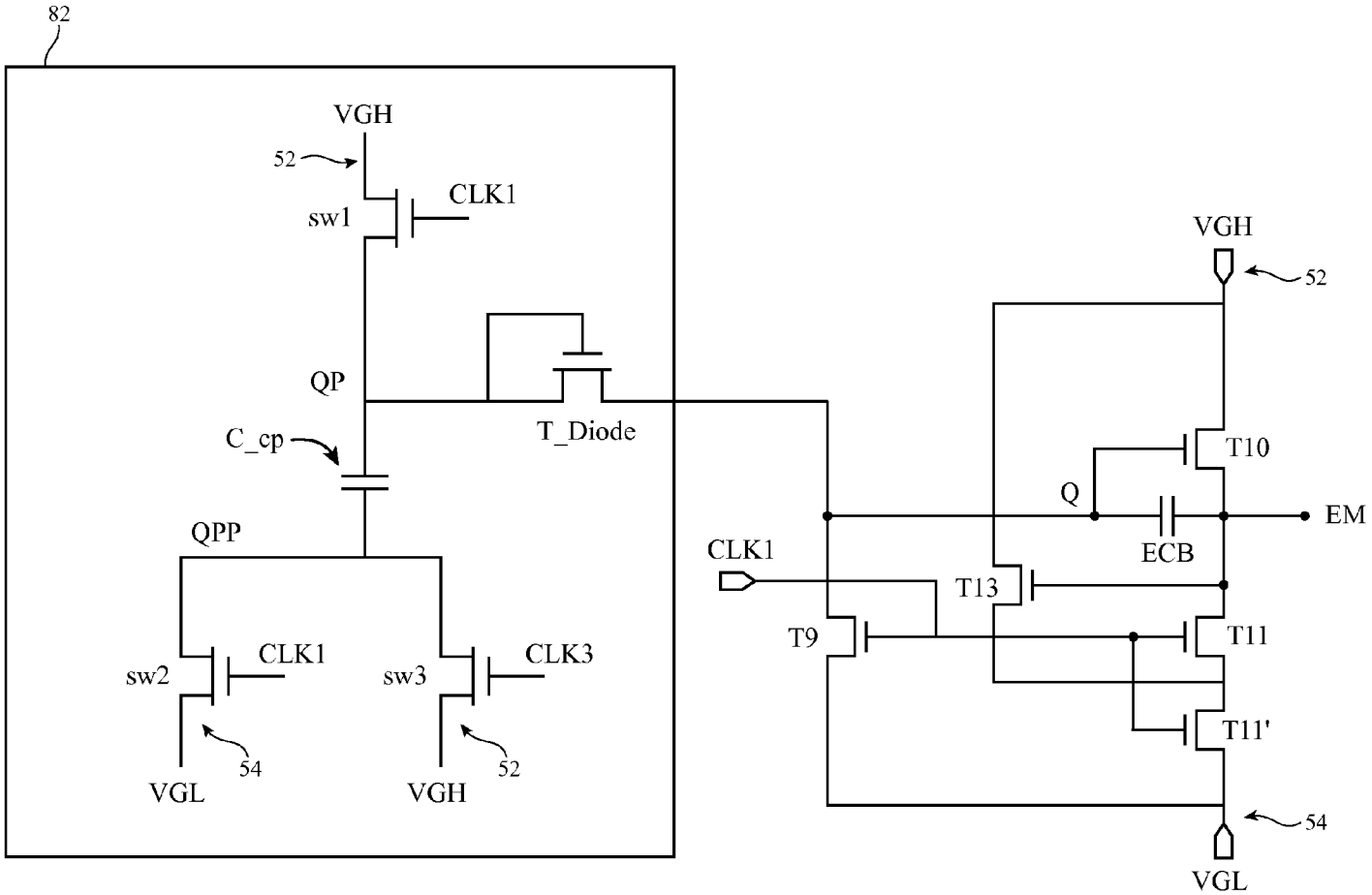
FIG. 10 is a circuit diagram of driver circuitry in thin-film display driver circuitry with capacitive charge boosting and charge pump circuitry in accordance with an embodiment.

If desired, output emission control signal may be maintained at logic one using charge pump circuitry as shown in FIG. 10. In the example of FIG. 10, charge pump circuitry 82 may be coupled to node Q (e.g., in place of pull-up transistor T12). Charge pump circuitry 82 may include diode-connected transistor T-Diode that serves as a diode. Transistor T_Diode may be enabled when the voltage at node QP (i.e., VQP) is greater than the voltage at node Q (i.e., VQ). Charge pump circuitry 82 may include switches SW1, SW2, and SW3 (e.g., transistors). Switch SW1 may be coupled between positive power supply terminal 52 and node QP and is controlled by clock signal CLK1. Switch SW2 may be coupled between node QPP and ground power supply terminal 54. Switch SW3 may be coupled between node QPP and positive power supply terminal 52. Capacitor C_cp may be coupled between nodes QP and QPP and may store charge for charge pump operations.

Figure 11:
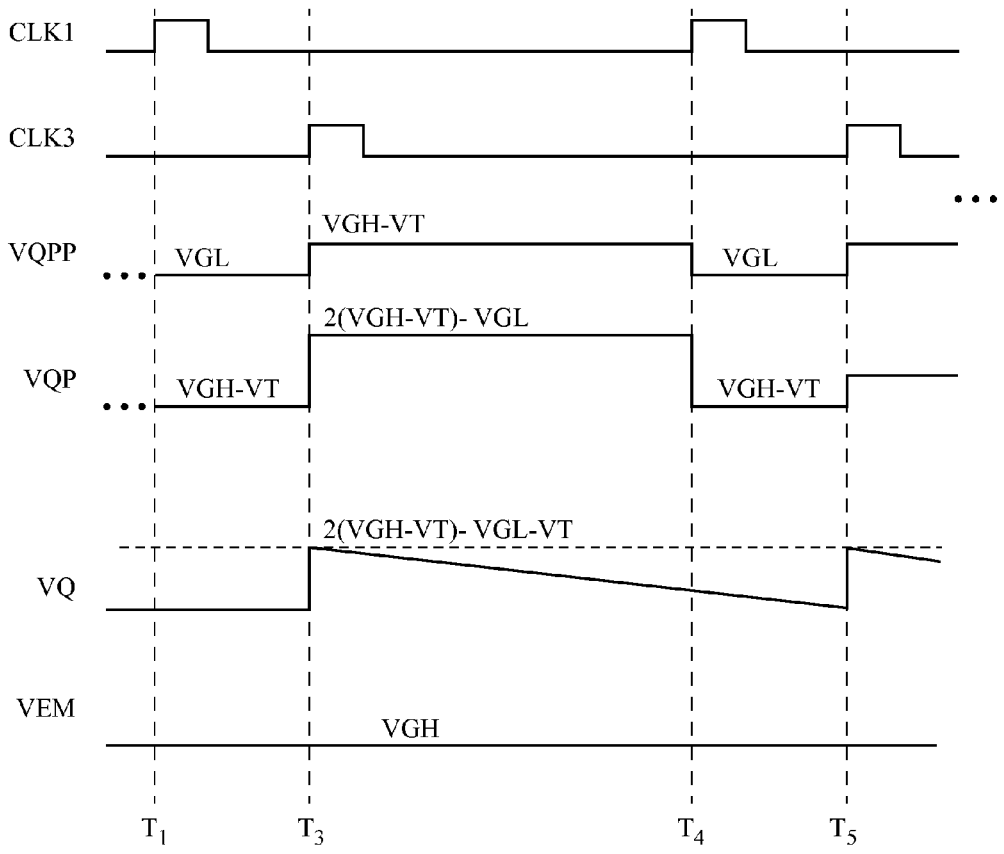
FIG. 11 is a timing diagram illustrating how the charge pump circuitry of FIG. 10 may help to ensure that an emission control signal is maintained at a logic one voltage in accordance with an embodiment.

Charge pump operations of charge pump 82 of FIG. 10 that may be performed to help maintain emission control signal EM at logic one are show in the illustrative timing diagram of FIG. 11. At time T1, clock one is pulsed, which enables switches SW1 and SW2. Switch SW1 passes voltage VGH-VT to node QP (e.g., due to transistor threshold voltage drop), whereas switch SW2 passes voltage VGL to node QPP. After clock signal CLK1 is de-asserted, switches SW1 and SW2 are disabled, which leaves nodes QPP and QP floating while capacitor C_cp stores charge maintaining the voltage across nodes QPP and QP. Subsequently, clock signal CLK3 may be pulsed at time T3, which enables switch SW3. Switch SW3 passes voltage VGH-VT to node QPP, which boosts the voltage at node QP to 2*(VGH−VT)−VGL (e.g., boosted by existing voltage VGH−VT−VGL across capacitor C_cp). Diode T_diode may be enabled and passes the voltage at node QP to node Q (with a voltage threshold drop), because VQP is greater than VGH and therefore also greater than VQ. The voltage at node VQ is therefore refreshed to 2*(VGH−VT)−VGL−VT at every pulse of clock signal CLK3.

Consider the exemplary scenario in which VGH is 12.5V, VGL is −5V, and VT is 1.5V. In this scenario, the voltage at node Q is periodically refreshed by clock signal CLK3 to 25.5V, which is substantially greater than VGH (12.5V) and helps to ensure that transistor T10 is enabled and passes VGH to emission control signal EM. In other words, charge pump circuitry 82 helps to ensure that emission control signal EM is maintained at the logic one voltage by counteracting any leakage through transistors such as transistors T9, T11, and T11'.

Figure 12:
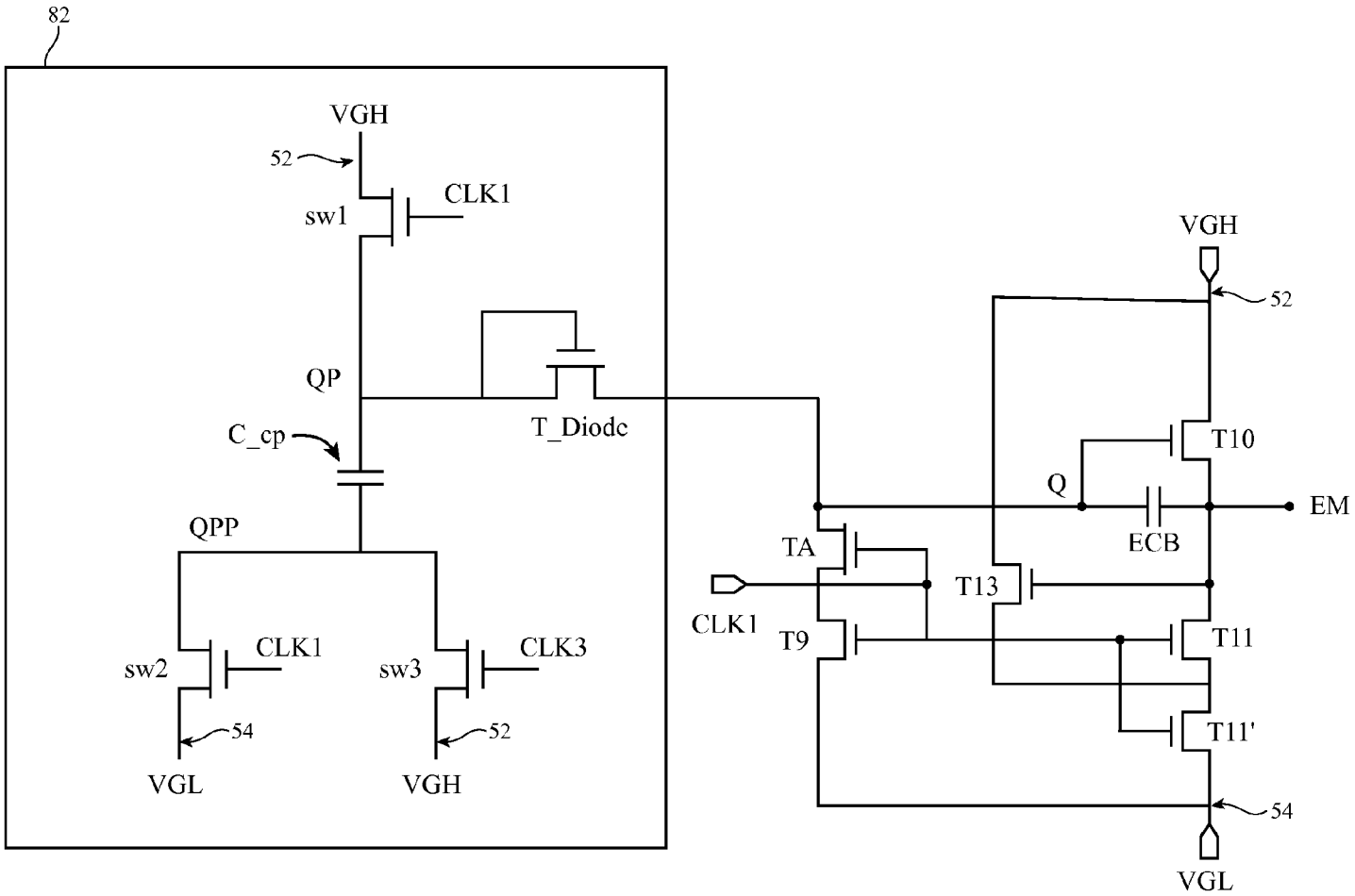
FIG. 12 is a circuit diagram of driver circuitry in thin-film display driver circuitry with capacitive charge boosting, charge pump circuitry, and a stacked transistor arrangement in accordance with an embodiment.

If desired, the charge pump arrangement of FIG. 10 may be combined with the stacked transistor arrangement of FIG. 5 as shown in FIG. 12 to provide improved performance. As shown in FIG. 12, charge pump 82 may periodically refresh the voltage at node Q while transistor TA helps to reduce leakage current through transistor T9.

The foregoing is merely illustrative and various modifications can be made by those skilled in the art without departing from the scope and spirit of the described embodiments. The foregoing embodiments may be implemented individually or in any combination.

What is claimed is:

1. Row driver circuitry in an organic light-emitting diode display including at least one display pixel, the row driver circuitry comprising:

an output terminal at which an emission control signal for the at least one display pixel is produced;

an input terminal that receives a periodic input signal;

a pull-down transistor having a source terminal and a first gate terminal, wherein the first gate terminal is coupled to the input terminal and receives the periodic input signal;

a pull-up transistor having a second gate terminal;

a bootstrap capacitor coupled between the second gate terminal and the output terminal; and a path that electrically couples the source terminal of the pull-down transistor to the output terminal.

2. The row driver circuitry defined in claim 1 wherein the pull-up transistor is coupled between a positive power supply terminal and the output terminal, wherein the second gate terminal is coupled to an intermediate node, and wherein the pull-down transistor has a drain terminal that is coupled to the intermediate node.

3. The row driver circuitry defined in claim 2 wherein the pull-up transistor comprises a first pull-up transistor and wherein the periodic input signal comprises a first periodic input signal, the row driver circuitry further comprising:

a second pull-up transistor coupled between the positive power supply terminal and the intermediate node, wherein the second pull-up transistor is controlled by a second periodic input signal.

4. The row driver circuitry defined in claim 3 further comprising:

a pair of pull-down transistors coupled in series between the output terminal and a ground power supply terminal, wherein the pair of pull-down transistors are controlled by the first periodic input signal.

5. The row driver circuitry defined in claim 4 further comprising:

a third pull-up transistor coupled between the positive power supply terminal and an additional intermediate node between the pair of pull-down transistors, wherein the third pull-up transistor is controlled by the emission control signal.

6. The row driver circuitry defined in claim 5 wherein each of the transistors is an N-type thin-film transistor.

7. The row driver circuitry defined in claim 5 wherein each of the transistors is an P-type thin-film transistor.

8. Row driver circuitry in an organic light-emitting diode display including at least one display pixel, the row driver circuitry comprising:

an output terminal at which an emission control signal for the at least one display pixel is produced;

a pull-up transistor that is coupled between a positive power supply terminal and the output terminal, wherein the pull-up transistor has a first gate terminal that is coupled to an intermediate node; and a pair of stacked pull-down transistors that are coupled in series between the intermediate node and a ground power supply terminal.

9. The row driver circuitry defined in claim 8 wherein the pair of stacked pull-down transistors has second and third gate terminals that receive a periodic input signal.

10. The row driver circuitry defined in claim 9 further comprising:

a capacitor that is coupled between the intermediate node and the output terminal, wherein the capacitor boosts voltage at the intermediate node to enable the pull-up transistor during display frames.

11. The row driver circuitry defined in claim 10 further comprising:

an additional pull-up transistor that is coupled between the positive power supply terminal and the intermediate node, wherein the additional pull-up transistor is controlled by an additional periodic input signal.

12. The row driver circuitry defined in claim 11 further comprising:

an additional pair of pull-down transistors that are coupled in series between the output terminal and the ground power supply terminal.

13. The row driver circuitry defined in claim 10 further comprising charge pump circuitry that is coupled to the intermediate node.

* * * * *